US009885515B2

(12) United States Patent
Osbar et al.

(10) Patent No.: US 9,885,515 B2
(45) Date of Patent: Feb. 6, 2018

(54) REFRIGERATION APPLIANCE WITH MOVABLE FRONT PANEL

(71) Applicant: BSH HAUSGERAETE GMBH, Munich (DE)

(72) Inventors: Bernd Osbar, Aalen (DE); Gerald Schmidt, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/433,154

(22) Filed: Feb. 15, 2017

(65) Prior Publication Data

US 2017/0241699 A1 Aug. 24, 2017

(30) Foreign Application Priority Data

Feb. 19, 2016 (DE) ..... 10 2016 202 614

(51) Int. Cl.

| | |
|---|---|
| ***A47B 96/04*** | (2006.01) |
| ***F25D 23/02*** | (2006.01) |
| ***E05B 65/00*** | (2006.01) |
| ***E05C 1/08*** | (2006.01) |
| ***E05C 19/16*** | (2006.01) |
| ***F25D 23/04*** | (2006.01) |

(52) U.S. Cl.

CPC ..... *F25D 23/028* (2013.01); *E05B 65/005* (2013.01); *E05C 1/08* (2013.01); *E05C 19/168* (2013.01); *F25D 23/04* (2013.01); *F25D 2323/021* (2013.01)

(58) Field of Classification Search

CPC .... F25D 23/02; F25D 23/025; E05B 65/0042; E05B 65/005

USPC ..... 312/215, 222, 402, 404, 405, 405.1

See application file for complete search history.

(56) References Cited

U.S. PATENT DOCUMENTS

| | | | | |
|---|---|---|---|---|
| 5,339,662 | A * | 8/1994 | Goldman | E05B 47/0002 70/277 |
| 6,374,649 | B1 * | 4/2002 | Holcomb | E05B 65/468 312/215 |
| 8,167,386 | B2 * | 5/2012 | Bergesch | E05B 65/02 292/32 |
| 8,833,118 | B1 * | 9/2014 | McLane | E05C 1/08 248/229.15 |
| 2008/0066506 | A1 | 3/2008 | Carbajal et al. | |
| 2011/0288685 | A1 * | 11/2011 | Usem | G07F 17/12 700/275 |
| 2011/0291846 | A1 * | 12/2011 | Burdenko | E05B 47/0004 340/635 |
| 2013/0081421 | A1 * | 4/2013 | Kwon | F25D 23/04 62/440 |

(Continued)

FOREIGN PATENT DOCUMENTS

| | | | |
|---|---|---|---|
| DE | 29504813 | U1 | 7/1995 |
| EP | 2113621 | A1 | 11/2009 |

OTHER PUBLICATIONS

Webster's II Dictionary 214-15, 406-07 (3d ed. 2005).*

*Primary Examiner* — Matthew W Ing

(74) *Attorney, Agent, or Firm* — Laurence A. Greenberg; Werner H. Stemer; Ralph E. Locher

(57) ABSTRACT

An appliance body of a refrigeration appliance can be closed off in its upper part by at least one door and receives a drawer in its lower part. The drawer can be locked in the closed position by a latch, which engages into a fitting part that supports the door.

16 Claims, 3 Drawing Sheets

(56) References Cited

U.S. PATENT DOCUMENTS

2013/0264930 A1* 10/2013 Kim ..... E05F 1/00
312/404

* cited by examiner

REFRIGERATION APPLIANCE WITH MOVABLE FRONT PANEL

CROSS-REFERENCE TO RELATED APPLICATION

This application claims the priority, under 35 U.S.C. § 119, of German application DE 10 2016 202 614.3, filed Feb. 19, 2016; the prior application is herewith incorporated by reference in its entirety.

BACKGROUND OF THE INVENTION

Field of the Invention

The present invention relates to a refrigeration appliance, in particular a cupboard-shaped refrigeration appliance such as a combined fridge/freezer, in which a movable front panel, e.g. a pull-out drawer, closes off a lower part of the appliance. A refrigeration appliance of this type is known from published, European patent application EP 2 113 621 A1.

In order to secure the drawer in its closed position, this known appliance has a securing element protruding beyond a front face of an appliance body or carcass, in which two latch parts spread apart by a spring are retained in a pivotable manner. A complementary securing element of the drawer contains two pins, which rise up from an upper edge of the drawer and engage behind the latch parts in a closed position of the drawer. When the drawer is pulled out and when it is pushed back into the closed position, the pins press the latch parts against one another counter to the force of the spring. This means that the drawer is secured in the closed position, but not protected from unauthorized access. Furthermore, the securing elements protruding beyond the upper edge of the drawer and the front face of the body are disruptive during use, as an item of clothing of a user could catch on them.

Locking systems for the doors of refrigeration appliances have been proposed on several occasions, such as in German utility model DE 29 504 813 U1 or U.S. patent publication No. 2008/0066506A1. These two make provision for protrusions overhanging the front face of the body, in order to be engaged into a latch thereon or to anchor it there.

SUMMARY OF THE INVENTION

The object of the invention is to specify a refrigeration appliance with a drawer, which enables a locking of the drawer, without requiring prominent protrusions which obstruct the use of the refrigeration appliance.

The object is achieved in a refrigeration appliance with a body, which can be closed off in an upper part by at least one door and in a lower part by a movable front panel, by the front panel being lockable in the closed position by a latch, which engages into a fitting part supporting the door.

The fitting part does also protrude beyond a front face of the body according to a preferred embodiment, yet as it supports the door, it is almost entirely concealed by the door and is thus extremely inconspicuous. Furthermore, there is no possibility for the clothing of a user to become entangled on the fitting part.

According to a preferred embodiment, the front panel is part of a drawer which is received in the lower part of the body such that it can be pulled out.

The front panel can also, however, be a door leaf.

In order to ensure an effective locking of the door leaf, an axis of the door leaf and the fitting part are preferably spaced far apart from one another, arranged on two opposing side walls of the body.

The latch is preferably electrically driven.

The latch should be able to be actuated by a supply voltage in the lower voltage region. On one hand, small format drives are available for this voltage range, which can be simply integrated into the front panel; on the other hand, simple, cost-effective measures for preventing the penetration of moisture into the drive of the latch may suffice if the supply voltage is low enough that a user himself is not endangered if direct contact is made with a surface conducting the supply voltage.

The latch should be retained by a permanent magnet in a position engaging into the fitting part and/or a position retracted into the front plate; the application of the supply voltage can then be limited to the short time periods during which the latch is moved. This minimizes the energy consumption of the latch drive. In addition, even when moisture reaches voltage-carrying surfaces, there is only a low risk of damage by electrolytic corrosion.

If, as already mentioned above, the fitting part protrudes beyond a front face of the body, the front panel can impact against the front face in the closed position.

Above the front panel, two doors are preferably hinged on opposing side walls of the body. Thus, in the case of the embodiment with the door leaf, one of the doors can be pivotable about the same axis as the door leaf, and the latch can engage into the fitting part of the other door.

In the embodiment with the drawer, two latches can be arranged on the front panel, in order to engage into fitting parts of the two doors. A tilting of the drawer thus can be prevented, should a user attempt to pull it out in spite of the locking.

The latch can expediently be controlled by a sensor, which responds to the reaching of the closed position of the front panel.

The sensor can interact with a control unit, which is configured to bring the latch into a position engaging into the fitting part when the sensor signals the reaching of the closed position of the front panel, and thus to automatically lock the front panel when a user has brought it to its end stop against the body.

Alternatively or additionally, the control unit can be configured to retain the latch in a position retracted into the front panel, so long as the sensor signals that the front panel is not located in the closed position. This is important in order to prevent a collision of the latch with the fitting part, which could lead to damage to the latch or the front panel.

An operating element for controlling the latch can be arranged on a front face of the front panel.

Alternatively or additionally, the latch can also be controlled wirelessly, in particular by an RFID transponder or an application which runs on a mobile phone, another mobile device or a computer of a user communicating with the control unit via a—preferably wireless—network.

Control of the latch via a fingerprint scanner is also taken into consideration.

Other features which are considered as characteristic for the invention are set forth in the appended claims.

Although the invention is illustrated and described herein as embodied in a refrigeration appliance with a movable front panel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
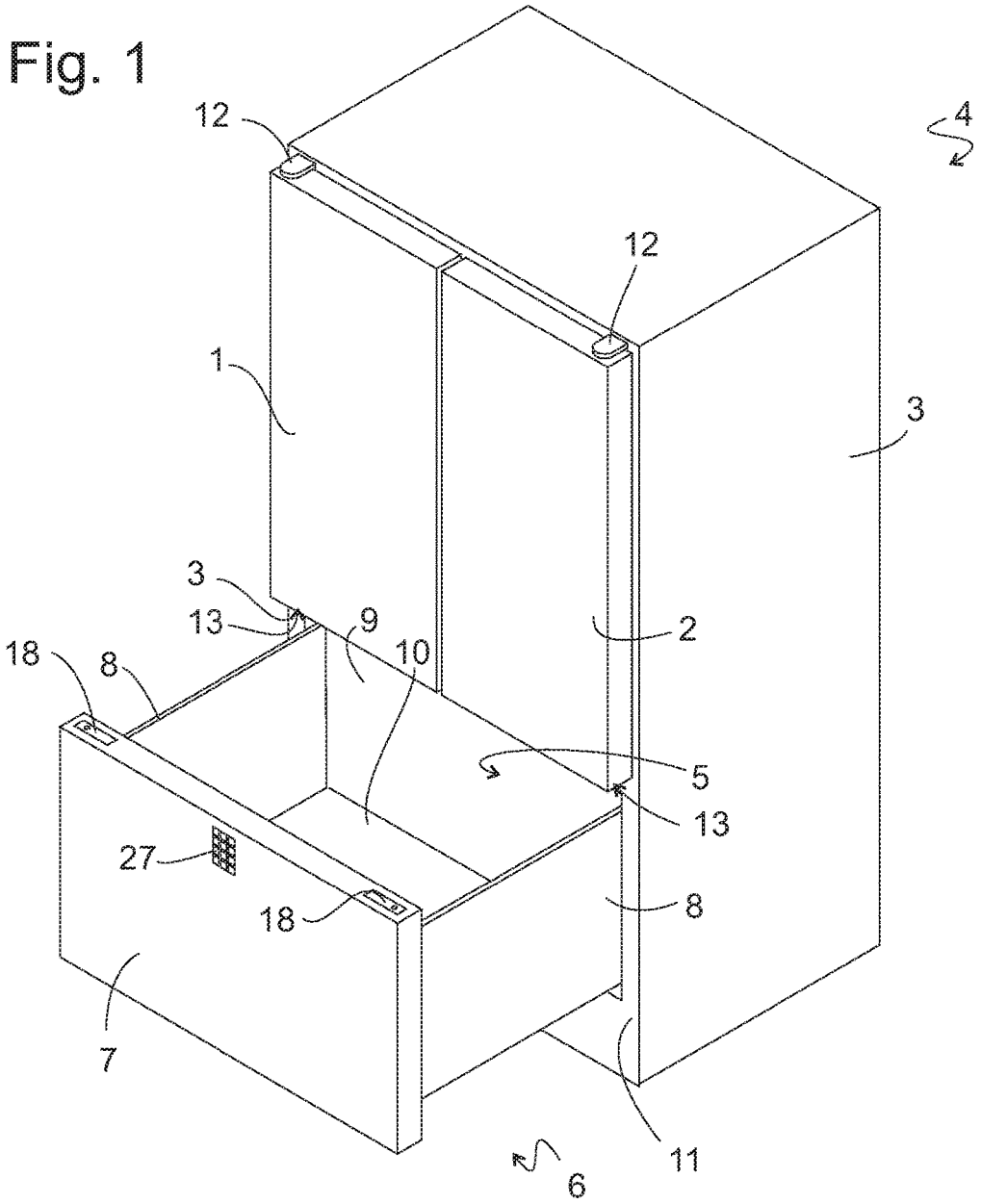
FIG. 1 is a diagrammatic, perspective view of a refrigeration appliance according to the invention.

Referring now to the figures of the drawings in detail and first, particularly to FIG. 1 thereof, there is shown a perspective view of a cupboard-type domestic refrigeration appliance according to the invention. Doors 1, 2 are hinged on the front edges of side walls 3 in an upper part of the appliance body or carcass 4. The doors 1, 2 close off a storage chamber extending across the entire width of the body 4, typically used as a normal refrigerator compartment, in the upper part. A second storage chamber 5, typically a freezer compartment, is located in a lower part of the body 4. A drawer 6 is received by the second storage chamber 5.

The drawer 6 is shown in FIG. 1 in an open position pulled out from the storage chamber 5. It contains a front panel 7 provided with a heat-insulating filling, side walls 8, a rear wall 9 and a bottom panel 10. In the closed position of the drawer 6, only the side walls 8, the rear wall 9 and the bottom panel 10 are inserted into the storage chamber 5. The front panel 7 is wider than the storage chamber 5 and, in the closed position, rests with its rear face against the front edges of the side wall 3, which form the front face 11 of the body 4.

In each case, a fitting part 12 anchored to the body 4 in an immovable manner can be seen on the upper face of the doors 1, 2. A mirror-inverted fitting part 13, concealed in FIG. 1, engages onto the lower face of the doors. One of these is shown in an enlarged view in FIG. 2. It contains a base plate 14 fastened, e.g. screwed, so as to rest against the front face 11, from which a flat support arm 15 protrudes forward. At the point of the support arm 15, a hinge pin 16 projects vertically upward and is provided to engage into a hinge bush on the lower face of the door 2 and thus, together with a complementary hinge pin of the upper fitting part 12, to define the pivot axis of the door 2.

Figure 2:
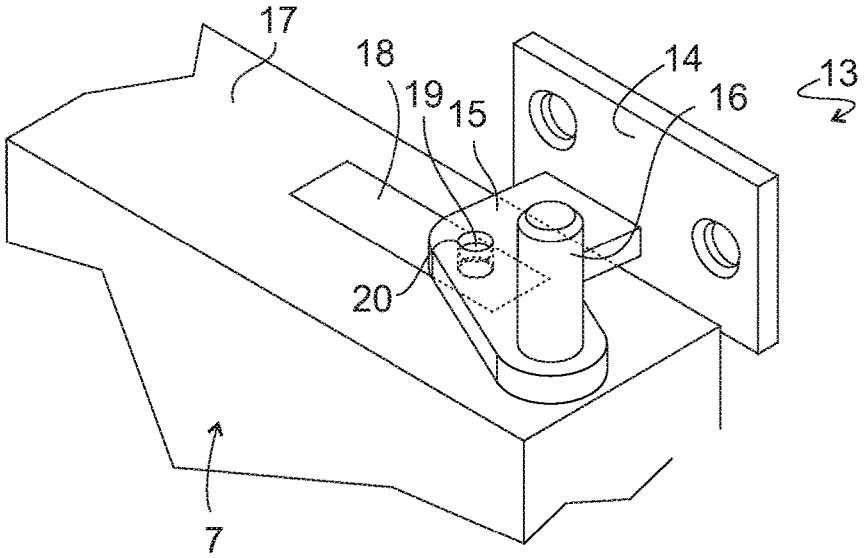
FIG. 2 is a partial, perspective view of an enlarged detail of the refrigeration appliance.

If the drawer 6 is located in the closed position, the support arm 15 extends closely beyond an upper face 17 of the drawer 6. Embedded into this upper face, below each fitting part 13, is a locking component group 18, the structure and function of which will be explained on the basis of FIG. 3. Belonging to the locking component group 18 is a vertically movable latch 19, which in FIG. 2 is shown dashed as it is mostly concealed below the support arm 15. Only a point of the latch 19, which engages into a bore hole 20 of the support arm 15 from below, can be seen directly, in order to lock the drawer 6 in the closed position.

Figure 3:
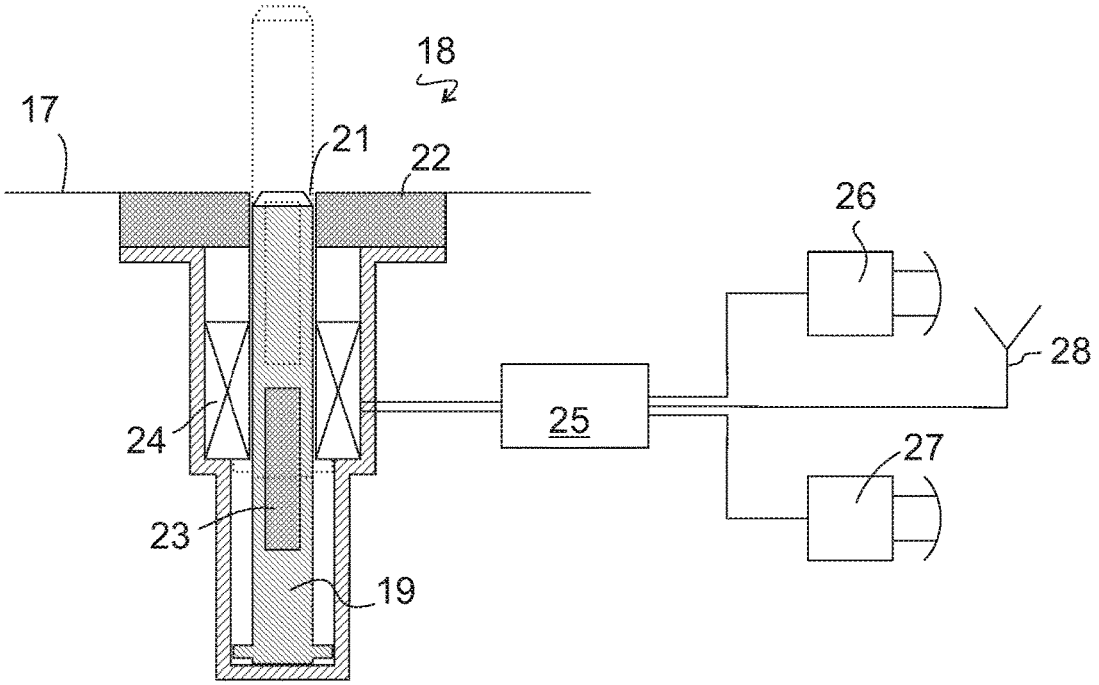
FIG. 3 is a sectional view of a drive and control of a latch.

FIG. 3 shows a vertical section through the locking component group 18. Here, the latch 19 is located in a retracted, unlocked position, in which its point is flush with the upper face 17. The point is located in a bore hole 21 of a cover plate 22 of the locking component group 18. The cover plate 22 is made of permanent-magnetic metal, on one hand in order to form a robust bracket for the latch 19 which is unaffected by forces from the lateral direction, when the latch 19 protrudes beyond the upper face 18 in the locked position (shown dashed in FIG. 3), and on the other hand in order to hold the latch 19 stable in the raised locked position by interacting with an iron core 23 embedded in the latch 19.

A coil 24 surrounds the latch 19 in a position which lies above the iron core 23 in the unlocked position and below the iron core 23 in the locked position. Thus, the coil, when a short current impulse is applied to it, can both accelerate the latch upward from the unlocked position, so that its iron core 23 enters the magnetic field of attraction of a cover plate 22 and is drawn into the locked position by magnetic force. If the latch 19 is located in the locked position, the same current impulse causes a downward force, which releases the latch 19 from the locked position and allows it to fall into the unlocked position.

The voltage of the current impulse amounts to 12 V here.

The source of the current impulse is a control unit 25. The control unit 25 is coupled to a sensor for detecting the position of the latch. The sensor can be the coil 24 itself, to which a weak current is applied by the control circuit 25 which is not sufficient to drive a movement of the latch 19, but which enables a measurement of the inductance of the coil 24, from which value the position of the latch 20 can be inferred. The control unit is further coupled to a sensor 26, which is configured to detect whether the drawer 6 is located in its closed position or not. The sensor 26 can, for example, be a switch on the rear face of the front panel 7, which is actuated by contact with the front face 11.

So long as the drawer 6 is not closed and the latch 19 is located in the unlocked position, the generation of a current impulse, through which the latch 19 could be displaced into the locked position, is excluded. If the signal of the sensor 26 reverses and shows that the drawer 6 is located in the closed position, a current impulse is generated, in order to bring the latch 19 into the locked position.

Should the detection of the latch position show that the locked position was not achieved, the current impulse can be output once more. If this occurs a number of times without success, then there may be provision for a warning signal to be output for the user.

An operating element 27, by means of which the unlocking can be triggered, is preferably attached to a front face of the drawer 6. To protect against unauthorized access, the operating element 27 can be embodied as a fingerprint scanner or as a keypad, which only responds to the input of a predefined button combination, which the user can preferably define.

Furthermore, a radio interface 28 can be provided, which responds e.g. to the presence of an RFID tag carried by the user or an item of authentication information transmitted by a smart phone or another mobile device of the user. There may be provision that, when the radio interface 28 of the control unit 25 indicates the presence of an authorized user, it brings the latch 19 into the unlocked position, so that the user can access the drawer 6 at any time, as if it were not secured. As soon as the radio interface 28 loses contact with the RFID tag or the mobile device of the user, which implies that the user is no longer in the surrounding area of the refrigeration appliance, the control unit switches the latch 19 back into the locked position.

Alternatively, if the radio interface 28 is provided for verifying the authentication of a user, a simple button which the user presses to unlock the drawer, suffices as operating element 27. The control unit 25 subsequently attempts to respond to an RFID tag or a mobile device of the user via the radio interface 28. If this is successful, then this is considered to be proof that the user is in the vicinity and the drawer 6 is unlocked. If no response is received from the RFID tag or mobile device, then the drawer remains locked.

A permanent magnet may also be arranged on the fitting part 13 instead of in the cover plate 22. Thus, in the raised position the latch 19 is only stable when it is held firmly by the permanent magnet in the bore hole 20 of the fitting part 13; if this is not possible, because the drawer 6 is not located in the closed position, then the latch 19 always falls back into the unlocked position.

Figure 4:
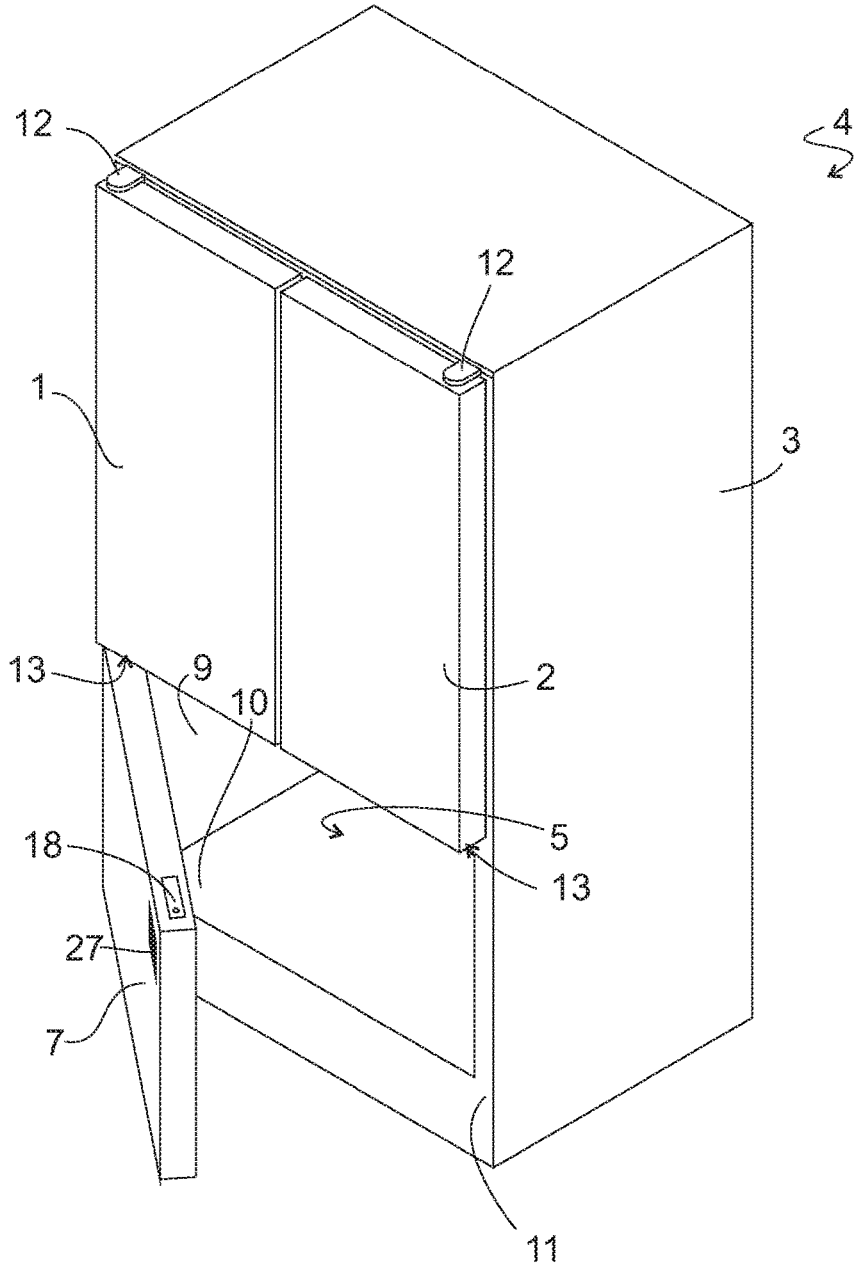
FIG. 4 is a perspective view of a second embodiment of the refrigeration appliance.

FIG. 4 shows a second embodiment of the refrigeration appliance in a perspective view analogous to FIG. 1. The front panel 7 is embodied here as a door leaf, which can be pivoted about a pivot axis 29 shared with the door 1 from the shown open position into a closed position resting against the front face 11 of the body 4. The locking component group 18 is embedded into the upper face 17 of the front panel 7 on its end facing away from the pivot axis 29, so that its latch 19 can engage into the fitting part of the opposing door 2 from below.

The following is a summary list of reference numerals and the corresponding structure used in the above description of the invention:

1 Door
2 Door
3 Side wall
4 Carcass
5 Storage chamber
6 Drawer
7 Front panel
8 Side wall
9 Rear wall
10 Bottom panel
11 Front face
12 Fitting part
13 Fitting part
14 Base plate
15 Support arm
16 Hinge pin
17 Upper face
18 Locking component group
19 Latch
20 Bore hole
21 Bore hole
22 Cover plate
23 Iron core
24 Coil
25 Control unit
26 Sensor
27 Operating element
28 Radio interface
29 Pivot axis

The invention claimed is:

1. A refrigeration appliance, comprising:
at least one door;
a fitting part supporting said door;
a movable front panel;
a body being closed off in an upper part by said at least one door and in a lower part by said movable front panel, said fitting part protruding beyond a front face of said body; and
a latch for locking said movable front panel to a closed position, said latch engaging into said fitting part.

2. The refrigeration appliance according to claim 1, further comprising a drawer and said movable front panel is part of said drawer, said drawer being received in said lower part of said body such that said drawer can be pulled out.

3. The refrigeration appliance according to claim 1, wherein said movable front panel is a door leaf.

4. The refrigeration appliance according to claim 3, wherein:
said body has two opposing side walls; and
an axis of said door leaf and said fitting part are disposed on said two opposing side walls of said body.

5. The refrigeration appliance according to claim 1, wherein said latch is electrically driven.

6. The refrigeration appliance according to claim 5, wherein said latch is able to be actuated by a supply voltage in a lower voltage region.

7. The refrigeration appliance according to claim 1, further comprising a permanent magnet for retaining said latch in at least one of a position engaging into said fitting part or a position retracted into said movable front plate.

8. A refrigeration appliance, comprising:
at least one door;
a fitting part supporting said door;
a movable front panel;
a body being closed off in an upper part by said at least one door and in a lower part by said movable front panel, said fitting part protruding beyond a front face of said body and said movable front panel impacting against said front face in a closed position; and
a latch for locking said movable front panel to the closed position, said latch engaging into said fitting part.

9. The refrigeration appliance according to claim 1, wherein:
said body has opposing side walls; and
said at least one door is one of two doors hinged on said opposing side walls of said body above said movable front panel.

10. The refrigeration appliance according to claim 9, wherein:
said latch is one of two latches;
said fitting part is one of two fitting parts; and
said movable front panel has said two latches which are disposed in order to engage into said fitting parts on each of said two doors.

11. The refrigeration appliance according to claim 1, further comprising a sensor for controlling said latch, said sensor responding to a reaching of the closed position by said movable front panel.

12. The refrigeration appliance according to claim 11, further comprising a control unit configured to bring said latch into a position engaging into said fitting part, when said sensor signals at least one of the reaching of the closed position of said movable front panel, or to retain said latch in a position retracted into said movable front panel, so long as said sensor signals that said movable front panel is not located in the closed position.

13. The refrigeration appliance according to claim 1, further comprising an operating element for controlling said latch, said operating element is disposed on a front face of said movable front panel.

14. The refrigeration appliance according to claim 1, wherein said latch can be controlled wirelessly.

15. The refrigeration appliance according to claim 1, wherein said latch can be controlled by a fingerprint scanner.

16. A refrigeration appliance, comprising:

at least one door;

a fitting part supporting said door, said fitting part including a support arm with a hinge pin engaging said at least one door;

a movable front panel;

a body being closed off in an upper part by said at least one door and in a lower part by said movable front panel; and a latch for locking said movable front panel to a closed position, said latch engaging into said fitting part.

* * * * *